United States Patent [19]

Johnston et al.

[11] Patent Number: 4,866,294

[45] Date of Patent: Sep. 12, 1989

[54] DOUBLE INSULATED STARTER MOTOR

[75] Inventors: William N. Johnston; Early C. McKnight, both of Columbus, Miss.

[73] Assignee: United Technologies Electro Systems Inc., Columbus, Miss.

[21] Appl. No.: 81,258

[22] Filed: Jul. 31, 1987

[51] Int. Cl.[4] ..... F02N 11/14

[52] U.S. Cl. ..... 290/38 R; 290/48

[58] Field of Search ..... 290/38 R, 48; 310/42, 310/43, 46, 47, 50, 51, 52, 59, 88–91; 74/6, 7 R, 7 A; 123/179 R, 179 B, 179 M

[56] References Cited

U.S. PATENT DOCUMENTS

| | | | |
|---|---|---|---|
| 3,476,960 | 11/1969 | Rees | 310/89 |
| 3,690,188 | 9/1972 | McMillen | 74/7 R |
| 3,791,684 | 2/1974 | Hamman | 290/38 |
| 3,791,685 | 2/1974 | Hamman | 290/38 |
| 3,982,146 | 9/1976 | Hokky | 310/89 |
| 4,175,237 | 11/1979 | Mazzorana | 290/38 R |
| 4,315,343 | 2/1982 | Meroda et al. | 310/89 |
| 4,347,442 | 8/1982 | White et al. | 290/48 |
| 4,384,224 | 5/1983 | Spitler et al. | 310/89 |
| 4,665,320 | 5/1987 | Debelio | 290/48 |

*Primary Examiner*—Vit W. Miska

[57] ABSTRACT

A double insulated starter motor for use with power equipment. A combination of insulating members about a motor together with various insulating members for electrically isolating the starter gear from the motor are collectively utilized to effect double insulation of a starter designed for use with power equipment, especially outdoor equipment subject to adverse environmental and operating conditions.

11 Claims, 2 Drawing Sheets

DOUBLE INSULATED STARTER MOTOR

DESCRIPTION

1. Technical Field

The field to which this invention pertains is the field of electrical starter motors and specifically double insulated starter motors used for starting internal combustion engines.

2. Background Of The Invention

The present invention is directed towards a double insulated starter motor suitable for use with engines of the types that are used to power equipment such as lawn mowers, garden tractors, snowblowers, and the like. The starter motor is intended to utilize 110 volt household current as a power source. The motor is connected by a power cord to a power supply, such as a conventional household outlet. The starter is energized from the outlet and once the engine for powering the power equipment has started, the electric power cord is disconnected from the starter and the equipment is then put to its intended use.

Since starters of this type utilize a power source of sufficient voltage and current potential has to be considered hazardous, caution must be taken to reduce the risk of injury to the equipment operator. Producers of motors that operate at a voltage of approximately 42 volts peak and above usually incorporate apparatus for providing a margin of safety. Broadly speaking, this has included either a third wire ground system or the application of secondary insulation to the motor as back-up in case the primary insulation fails. This is commonly referred to as "double insulation".

The primary insulation is considered to be that insulation which is required for the motor to perform. Examples of primary insulation would include the insulation that separates the winding from the armature, the brush rigging from the metal housing or enclosure, and insulation that normally separates the live conductors from the nonenergized metal parts. All these insulations are found in a typical electrical motor.

The secondary insulation is that insulation which prevents physical contact with a normally dead or nonenergized metal part that may become live or energized due to a malfunction of the motor, or an additional insulator that would prevent a normally nonenergized metal part from becoming live should the primary insulation fail.

Starter motors are designed to operate from a power source of hazardous potential and operate on equipment of the type mentioned. They require consideration above and beyond that given to most general purpose motor applications. The reasons for the special consideration include that equipment such as lawn mowers, snowplows, garden tractors, etc. are subject to operation under adverse conditions especially when wet. Furthermore, the operator who is operating the equipment is often also in a wet environment, may be standing on a wet surface, or may otherwise be exposed for receiving an electrical shock while handling the equipment.

Additionally, the starter motor is subject to severe shock and vibration during the engine cranking cycle and during engine operation since the starter is mounted to the engine. Additionally, consideration must be given to making the starter tamperproof. For example, if a third wire grounding system is used to render a normally dead metal part harmless in case it should become energized, the protection can be rendered ineffective by the user by the removal of the ground prong of a three-prong plug or by the use of a conventional outlet not having appropriate grounding included as a portion of the outlet. Unfortunately, in many older homes where the house wiring and wall receptacles will not accommodate a three-wire grounding system, the third prong is removed. At other times a three prong-to-two prong converter is utilized and a ground wire is not connected rendering the ground prong ineffective. For these and other reasons, a double insulated design may be advantageous for starters that operate from a power source that is of sufficient potential to be a shock hazard.

Specific starter drives for use with starter motors for cranking an engine to effect starting of the internal combustion engine have been utilized including resilient drive portions to effect shock absorption. For instance, U.S. Pat. No. 3,791,685 entitled Starter Pinion With Molded Base And Drive discloses the use of a rubber sleeve bonded to a gear to help absorb shock as the starter gear is displaced to engage a ring gear mounted to the flywheel of an engine.

Likewise in U.S. Pat. No. 3,690,188 an Engine Starter Drive Assembly is disclosed having an annular cushion member of resilient material to effect shock absorption. The herein-described starter drive portion of the double insulated starter motor uses resilient materials in similar applications, however, it uses them to obtain the electrical isolation necessary for a double insulated starter motor as opposed to merely using them to obtain shock absorption. Please note, for instance, that the gear of U.S. Pat. No. 3,791,685 is still electrically connected by metal-to-metal contact with the armature shaft such that although the resilient material serves a shock absorption function, it does not serve an electrical isolation function. In like manner gear 31 of the starter motor shown in U.S. Pat. No. 3,690,188 is coupled by a conductive part to the armature shaft.

The normal manner in which the starter motor is mounted to the engine includes securing it to the engine by bolts, in such a manner that a starting gear mounted on the armature shaft may engage a ring gear secured to the flywheel of the engine when the starter is energized. After the engine cranks and subsequently starts, and the start switch is released or the power cord is unplugged, the two gears become disengaged and the starter motor is no longer energized. The normal installation is such that a portion of the starter motor is external to the engine and therefore accessible to the operator. Another portion of the starter motor, normally part of the armature shaft and the starter gear that is mounted thereon, extends into the engine. Therefore, this portion is not directly or normally accessible.

In order to double insulate such a starter motor, it is necessary to provide insulation to the accessible or exposed portions of the starter such that the inadvertent contact thereof by an operator should not result in an electrical shock. Another secondary insulation means must be utililzed to electrically isolate the starter housing and bolts from the engine such that the engine does not become electrically live. Furthermore, during the cranking period when the starter gear and the armature shaft are engaged with the ring gear of the engine flywheel, appropriate electrical insulation means must be utilized to electrically isolate the armature shaft from the engine flywheel.

SUMMARY OF THE INVENTION

It is an object of the invention to provide a double insulated starter motor for use in cranking an internal combustion engine.

It is another object of the herein invention to provide an electric starter motor which may utilize sufficient power to present a shock hazard, said motor having secondary insulation means to provide protection to the operator in case of a motor failure or when other conditions occur which would otherwise render the starter and/or the equipment upon which it is mounted electrically unsafe.

It is yet another object of the invention to provide secondary insulation about a starter motor or those portions of the starter motor which are normally accessible to the operator of the equipment.

It is a still further object of the herein invention to electrically isolate the armature of a starter motor from the flywheel and other components of the engine.

It is a still further object of the invention to provide means for electrically isolating the starter motor from touch by the operator and, additionally, electrically isolating the armature of the motor from the engine.

It is a still further object of the present invention to provide a safe, economical, reliable, and easy to manufacture double insulated starter motor.

It is a still further object of the present invention to provide a double insulated starter motor having no exposed parts which are not double insulated.

Other objects will be apparent from the description to follow and the appended claims.

The above objects are achieved according to a preferred embodiment by the provision of a double insulated electric starter motor including thru bolts extending through the motor for use in mounting the motor to an engine. The motor includes a pair of end caps which together with the housing define an enclosure, said end caps having end cap openings through which the thru bolts extend. An armature is mounted to an armature shaft supported for rotational motion by bearings affixed within the enclosure. Also shown are means for providing a magnetic field about the armature, means for supplying electric power to the armature and an insulating sleeve positioned about the perimeter of the housing. A first insulating cover is positioned to cover one end cap and to mate with the insulating sleeve, said first insulating cover including bolt openings for the thru bolts and projections which extend through the end cap openings. A second insulating cover is further provided and is positioned to cover the other end cap and to also mate with the insulating sleeve. The thru bolts extend through the bolt openings of the first insulating cover, an end cap opening of one end cap of the enclosure, an end cap opening at the other end cap of the enclosure and the second insulating cover. A thru bolt insulating sleeve covering at least a portion of the exterior surface of the thru bolts is provided whereby the exterior surface of the motor and the engine to which the motor is mounted are protected from inadvertent electrical energization should the motor suffer from electrical failure.

Also disclosed is a starter mechanism for use with a double insulated starter motor having a rotating armature shaft and a starter gear for engaging a ring gear of an engine for starting the engine. An armature shaft including an extending portion having a threaded portion, and a plate mounted about the threaded portion of the armature shaft and having a threaded area to mate with the threaded portion of the armature shaft such that energization of the armature shaft causes relative motion therebetween to displace the plate along the shaft are disclosed. An insulating clutch member is secured to the plate to rotate and be displaced with the plate. The starter gear is mounted about the armature shaft in engagement with the clutch member which acts to drive the starting gear, said starting gear and the shaft defining a tubular space therebetween wherein an insulating sleeve is mounted to insulate the starting gear from the shaft. Also disclosed is means electrically insulated from the starter gear for displacing the plate and the gear upon deenergization of the armature shaft, said insulating clutch and insulating sleeve collectively electrically isolating the starting gear from the armature shaft such that the inadvertent electrical energization of the armature shaft does not electrically energize the ring gear of the engine.

A double insulated starter motor and drive suitable for cranking an engine having a ring gear are also described. The assembly includes a housing having thru bolts in which the electrical components of the motor are enclosed, an extending armature shaft mounted for rotational motion within the housing and having a threaded portion extending from the housing, insulation means mounted about the housing to electrically insulate the housing, insulating sleeves mounted about each thru bolt to electrically insulate the thru bolts from the electrical components of the motor, and said thru bolts extending to engage the motor to the engine. A plate means having a threaded portion, said plate means being mounted to the threaded portion of the armature shaft extending from the housing is additionally disclosed such that relative rotational motion between the shaft and the plate means will cause axial displacement of the plate means. Further disclosed is a starter gear positioned to be displaced by the plate means to engage the ring gear of the engine and to be rotated by the shaft means together with mounting means for mounting the starter gear to the armature shaft for obtaining the desired displacement and rotation of the starter gear while electrically isolating the starter gear from the shaft whereby the failure of an electrical component of the motor is prevented from electrically energizing the engine.

PREFERRED EMBODIMENT OF THE INVENTION

The herein invention will be described in reference to a double insulated starter motor sized and designed for use with a lawn mower, garden tractor, snowplow or other small internal combustion engine. It is to be understood that various other end uses for this motor and starter combination could be utilized. It is further to be understood that the appropriate size and positioning of the components selected depends upon the final use to which the starter motor is put.

Figure 1:
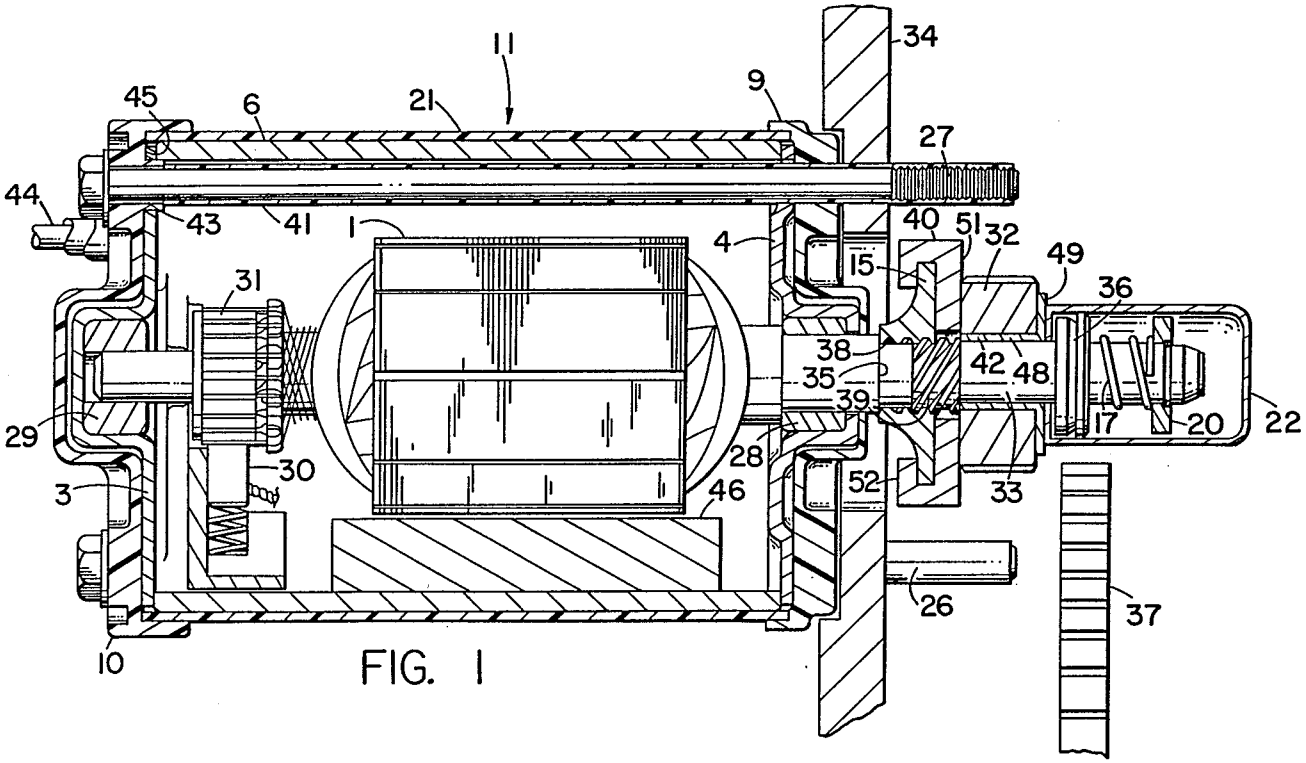
FIG. 1 is a partial sectional side view of a double insulated starter motor.

Referring to FIG. 1, there may be seen starter motor 11 mounted to engine 34 via thru bolts 26 and 27 such that starter gear 32 is positioned to be displaced to engage flywheel 37 including a ring gear mounted to the flywheel.

Portions of an electric motor are disclosed. Armature 1 is shown mounted to armature shaft 33 and is supported by bearings 28 and 29 for relative rotational motion. Commutator 31 acting together with brush 30 are shown for providing appropriate energization of the various windings of the armature. Permanent magnet 46 is shown positioned adjacent the armature to create the magnetic field which interacts with the fields created in the armature to effect rotation of the motor. Power cord 44 is shown for conducting electrical power to the motor. The motor operates in a conventional manner upon energization to effect rotation of the armature shaft.

Motor housing 6 together with end caps 3 and 4, defines an enclosure for containing the various electrical components of the motor such as the armature, commutator, brush, power lines and the like. Shown extending about the housing is insulating sleeve 21 which is of a generally cylindrical configuration and is located about the entire periphery of housing 6. Insulating cover 10 is shown mounted to cover end cap 3. Insulating cover 9 is shown mounted to cover end cap 4. The two insulating covers together with the insulating sleeve are all made of a dielectric material and effectively act to electrically isolate the metallic housing and end caps. The motor in this manner is isolated from casual touch by an operator and from the other metallic parts of the engine.

Additionally, thru bolts 26 and 27 are shown extending through insulating cover 10, through end cap 3, through the enclosure of the motor, through end cap 4, and through insulating cover 9 to engage engine 34. Each thru bolt has a bolt insulating sleeve 41 mounted about the entire perimeter of the bolt. This insulating sleeve is shown extending from insulating cover 10 through the motor, through insulating cover 9, and continuing about the threaded end portion of the bolts. Hence, inadvertent contact by any electrical component of the motor with the thru bolt will not act to electrically energize the thru bolt. The heads of the thru bolts are not insulated, however, they need not be since the bolt insulating sleeve acts to protect the bolt from energization as provided. It will be noted that projection portion 45 of the insulating cover extends through an opening defined in the end cap and mates with the bolt insulating sleeve such that continuous insulation is provided by the insulating cover and the bolt insulating sleeve at the juncture thereof.

Naturally, it is understood that the portion of the bolt insulating sleeve covering the thread portion of the bolt will be removed and there will be metal-to-metal contact between the thru bolts and the engine as the motor is assembled. However, the bolt insulating sleeve will remain intact within the motor enclosure and within insulating cover 9 such that the electrical isolation desired is still obtained.

Armature shaft 33 extends from the end of the motor and has a threaded portion 39. Coacting with this threaded portion is plate 15 which extends radially outward from the shaft and includes internal threaded portion 38. Upon rotation of the armature shaft, the plate is displaced relative to the armature shaft since the armature shaft accelerates faster from the plate and in this manner the plate is moved axially along the length of the armature shaft. Secured to and mounted about the plate is clutch member 40 having clutch face 51 which contacts gear 32 and having latching portion 52 extending on the opposite side of the plate to secure the clutch member in position. Gear 32 is shown mounted about the armature shaft and spaced therefrom and engaging the clutch face. Mounted between gear 32 and armature shaft 33 is sleeve 42 having cylindrical portion 48 between the armature shaft and the gear and flange portion 49 extending radially outward from the armature shaft abutting the end of the gear opposite a portion of the gear that contacts the clutch face.

Also shown is stop 20 mounted to the shaft to rotate therewith, but not to be displaced along the shaft. Cupped washer 36 is shown mounted about the shaft and secured in position via spring 17. Spring 17 extends from stop 20 to cupped washer 36 to bias the cupped washer in a leftmost direction. Cover 22 extends about the entire end of the armature shaft including stop 20 and cupped washer 36. Cover 22 includes a flange which extends to contact flange portion 49 of sleeve 42.

Figure 3:
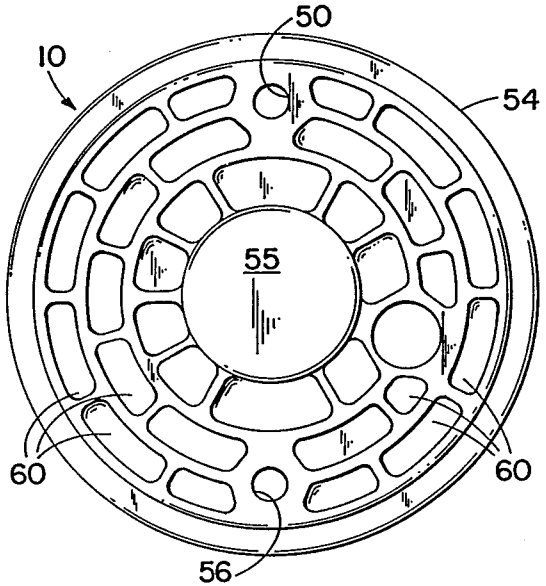
FIG. 3 is an end view of an insulating cover.
Figure 2:
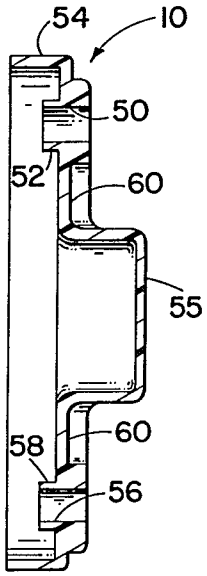
FIG. 2 is a sectional view of an insulating cover.

FIGS. 2 and 3 show a sectional view and an end view of insulating cover 10. Insulating cover 10 includes end projection 54, bolt opening 50, projection 52, bearing cover portion 55, bolt opening 56 and projection 58. Various air passages 60 may additionally be seen in FIG. 3.

When the motor is energized, the armature shaft accelerates and plate 15 is caused to be displaced from the left to the right. As the plate is displaced from left to right, the clutch member 40 is displaced from left to right displacing gear 32 from left to right until gear 32 engages ring gear of flywheel 37. Since displacement to the right is limited, the plate and clutch gear now accelerate to the rotating speed of the motor. This acts to drive the starter gear to the speed of the motor which acts to rotate the flywheel to effect cranking of the engine until the engine starts. Once power to the starter motor is removed, the spring 17 which is compressed by the displacement from the left to the right of the gear acts to displace the cupped washer, and consequently the gear, the clutch member and the plate all to the left disengaging the gear from the flywheel and placing the various components back in the position as shown in FIG. 1.

It may be further noted from FIG. 1 that the various components are arranged, such that the starting gear is electrically isolated from the ring gear of the flywheel. Plate 15 is a mechanically coupled metal-to-metal part with armature shaft 33. However, clutch member 40 positioned about the plate is a dielectric member and it is this member which contacts starter gear 32 to drive the starter gear. Additionally, starter gear 32 is mounted having sleeve 42 with a tubular body portion 48 and flange portion 49 isolating the gear from the armature shaft. Hence, the starting gear 32 is electrically isolated from the shaft and cannot effectively transfer electrical energy to the flywheel thereby preventing the motor from being energized should the armature shaft become energized.

Additionally, insulating covers 9 and 10 and insulating sleeve 21 collectively electrically isolate the external portions of the motor which an operator may contact from the other components of the motor. Furthermore, the motor will be isolated from engine 34 since the only contact with engine 34 is either by insulating cover 9 or by thru bolts 27, which are themselves insulated from the electrical components of the motor by bolt insulating sleeves 41. Hence, this various combination of components acts to electrically isolate the motor from the engine and the starting gear from the flywheel such that the appropriate electrical protection is provided to the operator of the device.

The invention has been described with reference to a particular embodiment, however, it is to be understood by those skilled in the art that variations and modifications can be effected within the spirit and scope of the invention.

We claim:

1. A starter mechanism for use with a double insulated starter motor having a rotating armature shaft and a starter gear for conductive engaging a ring gear of an engine for starting the engine which comprises:

said armature shaft including an extending portion having a threaded portion;

a plate mounted about the threaded portion of the armature shaft and having a threaded area to mate with the threaded portion of the armature shaft such that energization of the armature shaft causes relative motion therebetween which displaces the plate along the shaft;

an insulating clutch member secured to the plate to rotate and be displaced therewith;

said starter gear being mounted about the armature shaft in engagement with the insulating clutch member which acts to drive the starting gear, said starting gear and the shaft defining a tubular space therebetween;

an insulating sleeve mounted in the tubular space to insulate the starting gear from the shaft; and means electrically insulated from the starter gear for displacing the plate and the gear upon deenergization of the armature shaft, said insulating clutch and insulating sleeve collectively electrically isolating the starting gear from the armature shaft such that inadvertent electrical energization of the armature shaft does not electrically energize the ring gear or the engine.

2. The apparatus as set forth in claim 1 and further comprising the insulating clutch being formed from a dielectric material which extends on both sides of the plate to secure the insulating clutch in position, said clutch including a clutch face which engages the starting gear and a latching portion engaging the opposite side of the plate from the clutch face.

3. The apparatus as set forth in claim 1 wherein the insulating sleeve has a tubular body portion positioned between the starter gear and the armature shaft and a flange portion extending radially outward to contact the starting gear at the end of the gear opposite from where the gear contacts the insulating clutch.

4. The apparatus as set forth in claim 1 wherein the means for displacing the plate and gear further comprises:

stop means mounted to the armature shaft;

washer means mounted to the shaft and sized to be displaceable along the shaft; and spring means mounted between the stop means and the washer means to bias the washer means away from the stop means.

5. The apparatus as set forth in claim 4 and wherein the means for displacing further comprises a cover means sized to encase the stop means, the washer means and the spring means, one portion of the cover means being positioned between the washer means and the insulating sleeve, said cover means and said washer means being displaced with the starting gear.

6. A double insulated starter motor and drive suitable for being mounted to an engine having a ring gear which comprises:

a housing having thru bolts extending within the housing in which the electrical components of the motor are enclosed;

an extending armature shaft mounted for rotational motion within the housing and having a threaded portion extending from the housing;

insulation means mounted about the housing to electrically insulate the housing;

insulating sleeves mounted about each thru bolt to electrically insulate the thru bolts from the electrical components of the motor, said thru bolts extending to engage the motor to the engine;

plate means having a threaded portion, said plate means being mounted to the threaded portion of the armature shaft extending from the housing, whereby relative rotational motion between the shaft and the plate means sill cause axial displacement of the plate, means;

a conductive starter gear positioned to be displaced by the plate means to engage the ring gear of the engine and to be rotated by the shaft means; and mounting means for mounting the starter gear to the armature shaft for obtaining the desired displacement and rotation of the starter gear while electrically isolating the starter gear from the shaft whereby the failure of an electrical component of the motor is prevented from electrically energizing the engine.

7. The apparatus as set forth in claim 6 wherein the mounting means further comprises an insulating clutch means mounted about the plate means in contact with the starter gear for effecting displacement of said gear.

8. The apparatus as set forth in claim 7 wherein the mounting means further comprises an insulating sleeve located between the starter gear and the armature shaft.

9. The apparatus as set forth in claim 6 wherein the insulation means comprises a first insulating cover positioned to cover a portion of the housing and to abut against the engine to which the motor is mounted, said insulating cover acting to electrically isolate the motor from the engine.

10. The apparatus as set forth in claim 9 wherein the thru bolts extend through the insulating cover to secure the motor to the engine.

11. The apparatus as set forth in claim 9 wherein the only motor components in contact with the engine are the thru bolts, the insulating cover and the starting gear, all of which are electrically isolated from the electrical components of the motor.

* * * * *